US010752428B2

(12) United States Patent
Das et al.

(10) Patent No.: US 10,752,428 B2
(45) Date of Patent: Aug. 25, 2020

(54) MODIFIED SPRAY HEAD

(71) Applicant: Reckitt Benckiser (Brands) Limited, Slough, Berkshire (GB)

(72) Inventors: Avijit Das, Haryana (IN); Nikki Collinson, Montvale, NJ (US); Scott Rudkin, Hull (GB); Christopher Witty, Hull (GB)

(73) Assignee: RECKITT BENCKISER (BRANDS) LIMITED, Slough, Berkshire (GB)

( * ) Notice: Subject to any disclaimer, the term of this patent is extended or adjusted under 35 U.S.C. 154(b) by 0 days.

(21) Appl. No.: 16/095,128

(22) PCT Filed: Apr. 12, 2017

(86) PCT No.: PCT/GB2017/051032
§ 371 (c)(1),
(2) Date: Oct. 19, 2018

(87) PCT Pub. No.: WO2017/187134
PCT Pub. Date: Nov. 2, 2017

(65) Prior Publication Data

US 2019/0144196 A1 May 16, 2019

(30) Foreign Application Priority Data

Apr. 28, 2016 (GB) ..... 1607417.1

(51) Int. Cl.
*B65D 83/38* (2006.01)
*B65D 83/28* (2006.01)

(52) U.S. Cl.
CPC ..... *B65D 83/384* (2013.01); *B65D 83/28* (2013.01)

(58) Field of Classification Search
CPC ..... B65D 83/384; B65D 83/28
See application file for complete search history.

(56) References Cited

U.S. PATENT DOCUMENTS

| | | | | |
|---|---|---|---|---|
| 4,396,152 | A | 8/1983 | Abplanalp | |
| 5,305,930 | A | 4/1994 | De Laforcade | |
| 5,549,228 | A * | 8/1996 | Brown | B65D 83/207 222/402.1 |
| 9,038,922 | B1 * | 5/2015 | McLeod | B05B 1/28 239/11 |

(Continued)

FOREIGN PATENT DOCUMENTS

| | | | |
|---|---|---|---|
| WO | 9416971 | A1 | 8/1994 |
| WO | 2009037487 | A2 | 3/2009 |

(Continued)

OTHER PUBLICATIONS

International Search Report and Written Opinion of the International Searching Authority for corresponding application PCT/GB2017/051032 dated Jul. 26, 2017.

(Continued)

*Primary Examiner* — Jeremy Carroll
(74) *Attorney, Agent, or Firm* — Norris McLaughlin, PA

(57) ABSTRACT

The invention relates to a modified spray head suitable for use with an aerosol composition. Preferably the spray head is suitable for use with an automatic aerosol dispensing device. The spray comprises a single piece of moulded plastic and an angled output section.

15 Claims, 10 Drawing Sheets

(56) References Cited

U.S. PATENT DOCUMENTS

| | | | | |
|---|---|---|---|---|
| 2008/0283625 | A1* | 11/2008 | Bedford | B65D 83/262 239/11 |
| 2012/0111898 | A1 | 5/2012 | Neuhaus | |
| 2012/0175433 | A1* | 7/2012 | Sell | B65D 83/201 239/461 |
| 2014/0070016 | A1 | 3/2014 | Butler et al. | |
| 2016/0047484 | A1 | 2/2016 | Chang | |

FOREIGN PATENT DOCUMENTS

| | | | |
|---|---|---|---|
| WO | 2014123417 | A1 | 8/2014 |
| WO | 2016025930 | A1 | 2/2016 |
| WO | 2017046616 | A1 | 3/2017 |

OTHER PUBLICATIONS

GB Search Report for corresponding application GB1607417.1 dated Oct. 3, 2016.

* cited by examiner

MODIFIED SPRAY HEAD

This is an application filed under 35 USC 371 based on PCT/GB2017/051032 filed 12 Apr. 2017, which in turn is based on GB 1607417.1 filed 28 Apr. 2016. The present application claims the full priority benefit of these prior applications and herein incorporates by reference the full disclosures of these prior applications.

FIELD OF INVENTION

The present invention relates to a modified spray head (or outlet head) suitable for a device for spraying a fluid from an aerosol canister and particularly but not exclusively to a device for spraying fluids such as fragrances, deodorising fluids and/or pest control fluids and the like.

BACKGROUND

Prior art devices for spraying fragrances, deodorising agents and sanitising fluids into a room consist of a mechanically actuated arm which is periodically activated to press down on a spray head secured to an aerosol canister containing the material to be sprayed.

The prior art devices are typically constructed as follows. An outer casing has an opening through which the spray is ejected. The casing has a removable section which is removed to allow a refill canister containing the spray material to be placed in the casing. A moulded spray head, comprised of two discrete parts, a main body 1 and an insert 9, as shown in FIG. 1, is placed over the outlet stem of an aerosol spray can. The spray head has an inlet section having an opening to be placed over the outlet stem of the aerosol canister. The spray head also has an outlet section comprising the insert 9. The actuation arm is located over the spray head and is caused periodically to press against the spray head to cause material from the aerosol can to be ejected through the spray head out of the opening in the casing and into the surroundings. The actuator arm is either battery powered or mains powered and can be set to activate at various time intervals which, for example, may be to activate every seven minutes, every fifteen minutes or every thirty minutes, whichever is set by a user.

A commercial example of such a device is the Air Wick Freshmatic® device.

A problem with the use of these devices is the complexity of their construction. The insert is required to provide the desired characteristics of the spray output. The internal shape and arrangement of the insert is varied to break up the spray output depending many parameters including the pressure of the canister, chemical formulation used, required spray pattern and droplet size.

It is an objective of the present invention to attempt to overcome these problems.

STATEMENT OF INVENTION

A spray head for a spray device, the spray head is formed from a single piece of moulded plastic, the spray head also comprising:

an inlet section having an opening adapted to receive an output stem of a spray material container, said opening forming a first end of a fluid channel for receiving spray material from the spray material container; and an outlet section adapted to eject spray material comprising a second opening forming a second end of the fluid channel for ejecting spray material from the device; and wherein the angle between the opening of the inlet section and the second opening of the outlet section is at least 95 degrees, preferably at least 100 degrees.

DETAILED DESCRIPTION OF THE INVENTION

Aerosol formulations are widely used to disperse active ingredients into the air or onto a surface to be treated.

Figure 1:
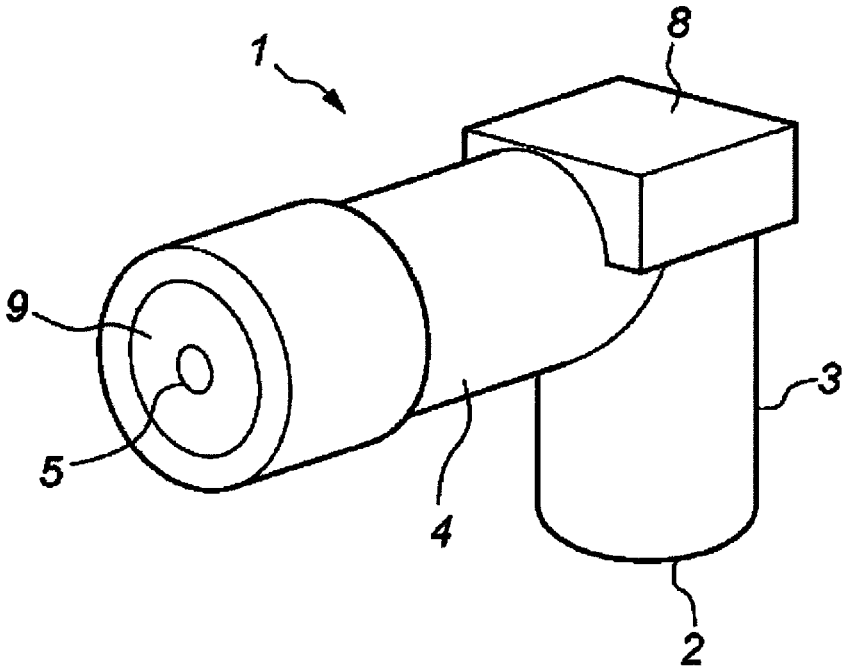
Figure 1 (Prior Art)
FIG. 1 illustrates a spray head of the art. Particularly one designed for use with an aerosol container and further particularly designed for use in an automatic aerosol dispenser device, such as Air Wick's Freshmatic® device.

FIG. 1 shows a well-known type of spray head used for aerosol formulations delivered by automatic dispensing devices. For example, the well-known FreshMatic® devices and refills from the Air Wick® brand.

For the purposes of the present invention the terms "spray head", "outlet head" and "actuator" may be considered to be interchangeable.

The valve stem for the aerosol canister can be inserted into opening 2 of inlet section 3. The fluid channel passes through the spray head via an outlet section 4 including an insert 9 to emerge at opening 5. The fluid generally exits the spray head at right angles to the valve stem and this is usually in a horizontal direction as the aerosol canisters are inserted vertically into the automatic dispensing devices. The outlet head includes an insert 9 that fits inside outlet section 4. The insert provides the desired physical parameters of the spray exiting the spray head.

These prior art spray heads as exemplified by FIG. 1 work very efficiently with normal aerosol formulations.

However the spray heads are two piece designs and therefore require some additional assembly steps. The inserts previously have been considered a requirement to get suitable spray performance from the spray heads.

It has now been surprisingly discovered that by adjusting the output angle of the outlet section of spray head, suitable spray characteristics can be achieved without requiring the use of an insert.

Figure 2:
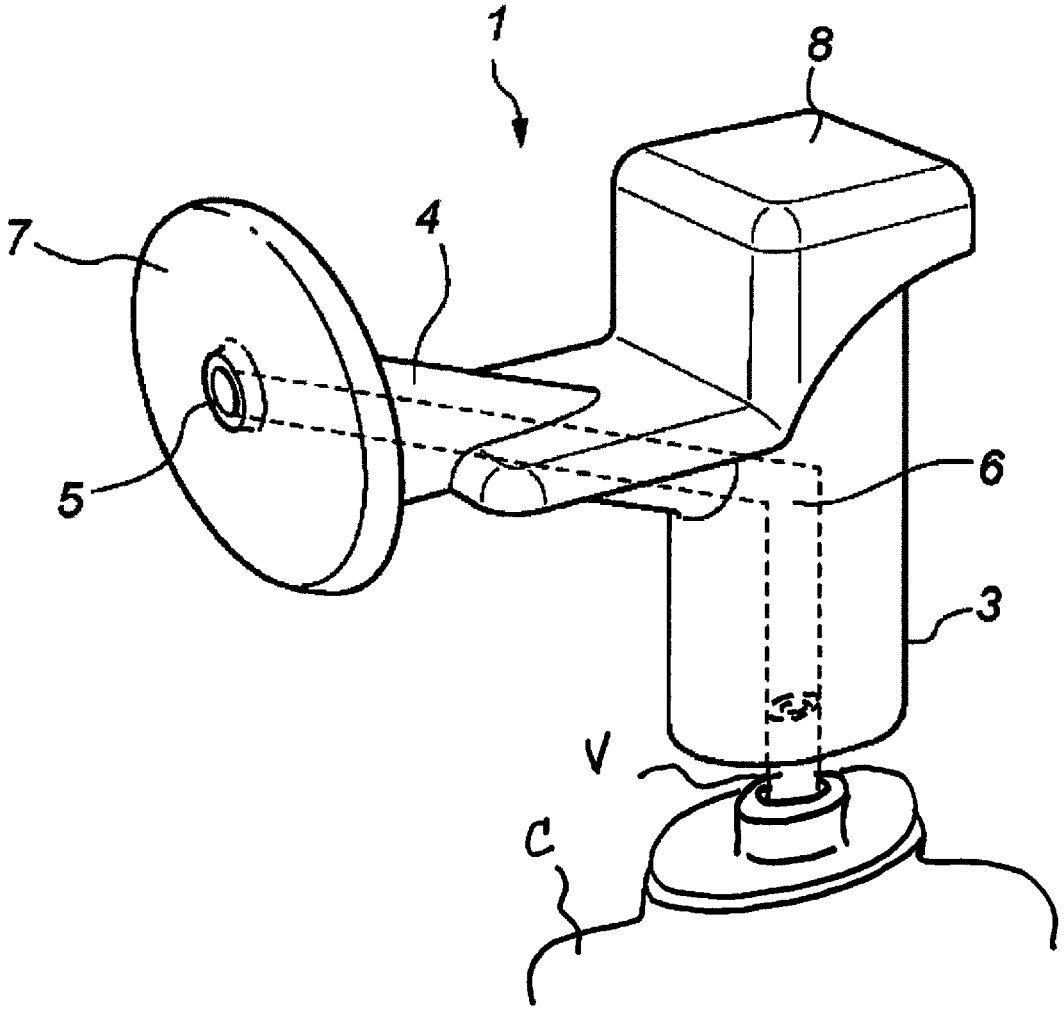
FIG. 2 shows a spray head of the present invention.
Figure 3:
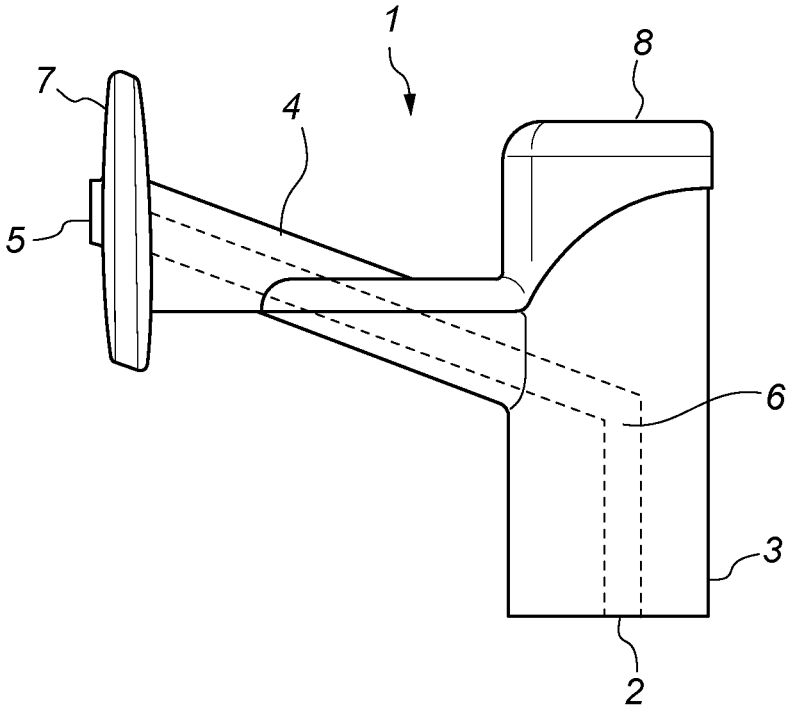
FIG. 3 shows a side view of the spray head of FIG. 2.
Figure 4:
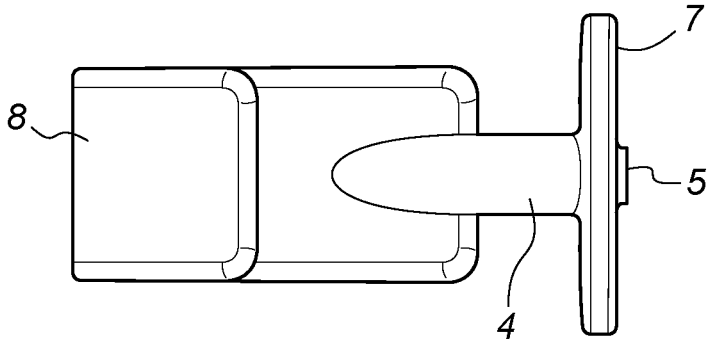
FIG. 4 shows the top view of the spray head of FIG. 2.
Figure 5:
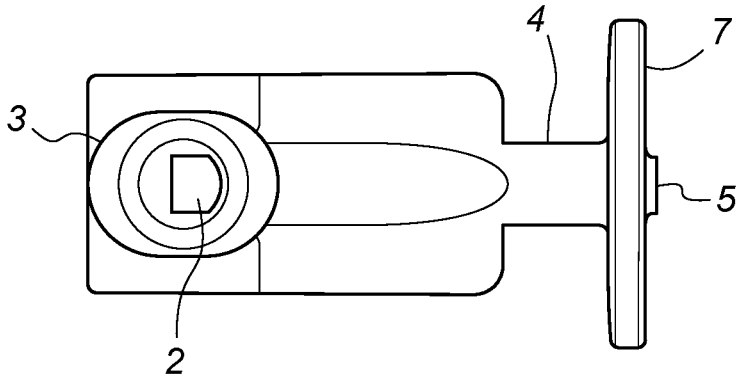
FIG. 5 shows the bottom view of the spray head of FIG. 2.
Figure 6:
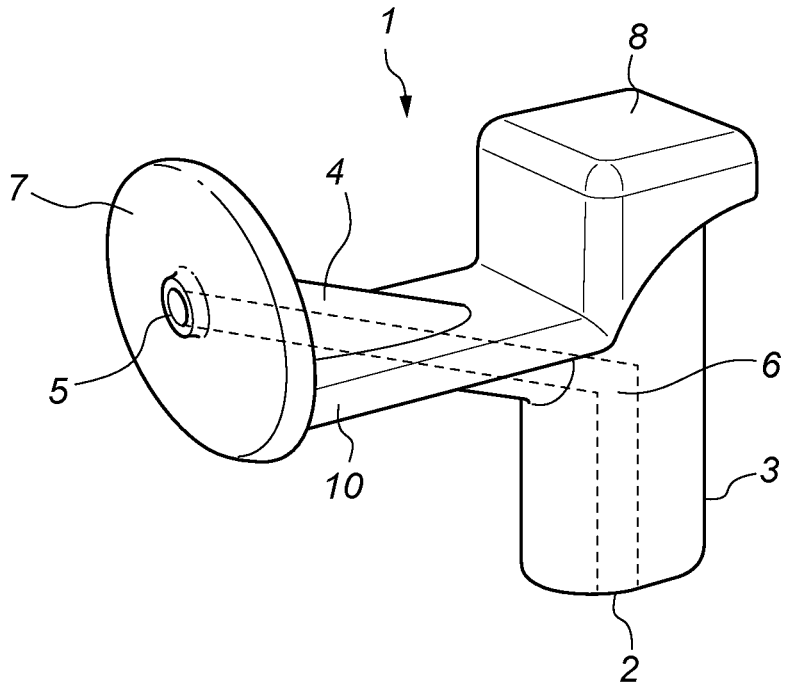
FIG. 6 shows an alternative spray head of the present invention.
Figure 7:
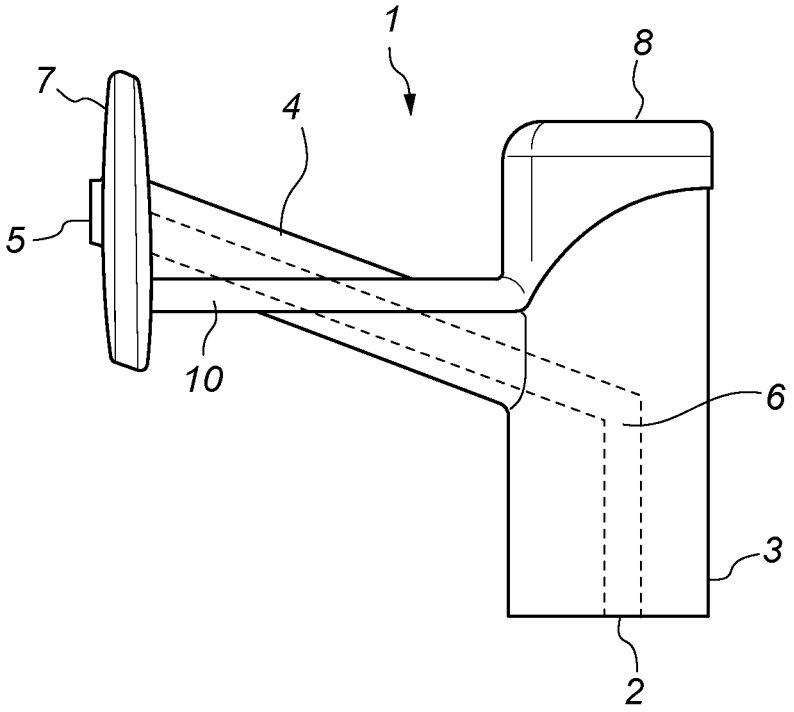
FIG. 7 shows a side view of the spray head of FIG. 6.
Figure 8:
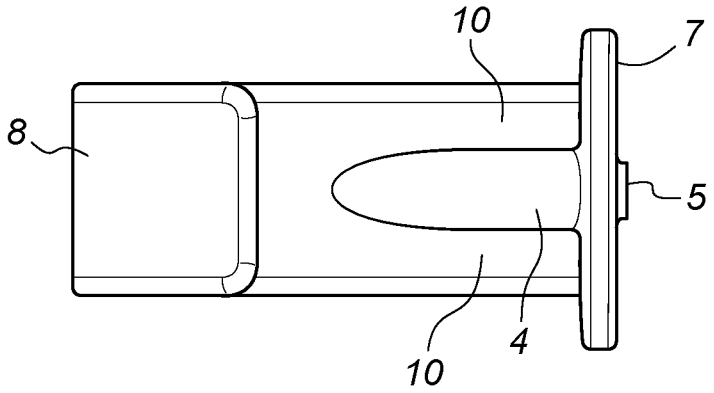
FIG. 8 shows the top view of the spray head of FIG. 6.
Figure 9:
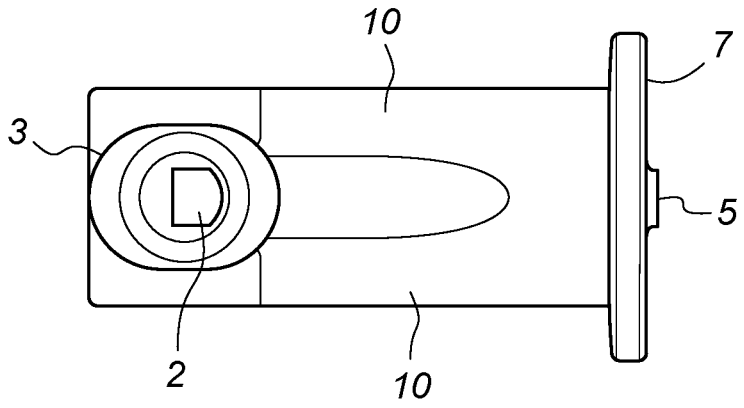
FIG. 9 shows the bottom view of the spray head of FIG. 6.
Figure 10:
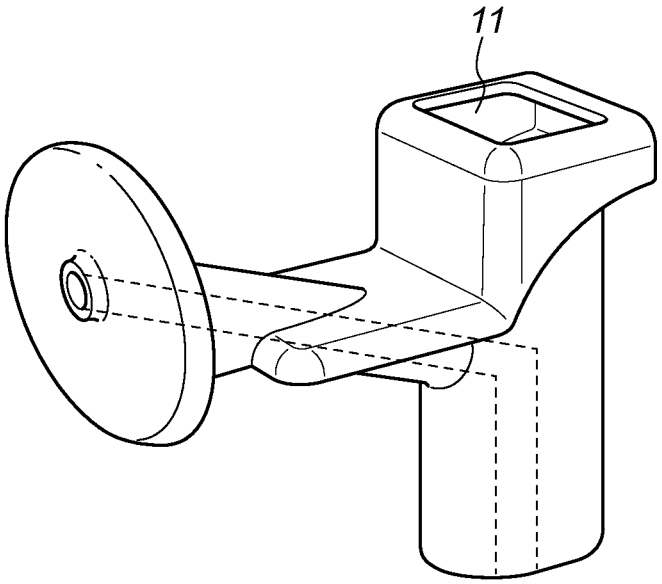
FIG. 10 shows an alternative version of the spray head of FIG. 2 with a hollowed top portion.
Figure 11:
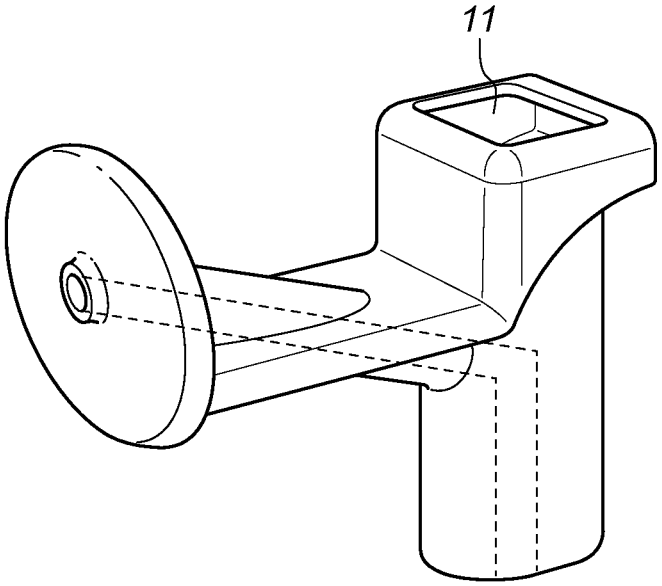
FIG. 11 shows an alternative version of the spray head of FIG. 6 with a hollowed top portion.

FIG. 2 illustrates a non-limiting example of a spray head of the present invention which is designed to over-come this problem. The spray head of FIG. 2 does not require an insert to adjust the spray output. FIGS. 3-5 show side, bottom and top views of the spray head of FIG. 2.

The spray head of the present invention 1 has an inlet section 3 comprising an opening 2. This inlet section 3 is designed to fit snugly over the valve stem V of a commercial aerosol canister C (a part of an aerosol canister is shown).

At the other end of the inlet section 3 is an external top face 8. This provides a good, wide, contact surface for the actuator arm of an automatic spray device.

The planar top surface 8 may be of any shape. Preferred shapes are squares and rectangles and substantially squares and rectangles.

A fluid channel 6 runs between opening 2 through the inlet section 3, through outlet section 4 to second opening 5 at the end of outlet section 4. The fluid exiting the aerosol canister follows the path of fluid channel 6 to exit the spray head.

The second opening 5 outlet section 4 is angled more than 95 degrees away from the opening 2 of the inlet section 3.

In general use this means that the outlet section ending in second opening 5 is angled at least 5 degrees above the horizontal plane.

It has surprisingly been found that by raising the exit path through the spray head alone no insert is needed to generate a suitable spray. (By the term "suitable spray" it is meant that the spray output from the device is dispersed effectively and that the spray does not form large droplets that will fall onto surfaces in front of the device).

Preferably the second opening of the outlet section is angled away at least 100 degrees, preferably at least 105 degrees, more preferably at least 115 degrees and most preferably at least 120 degrees from the opening 2 of the inlet section 3.

Preferably, in general use this means that the outlet section ending in second opening 5 is angled at least 10 degrees, preferably at least 15 degrees, more preferably at least 20 degrees and most preferably at least 25 degrees above the horizontal plane.

Preferably the angle is less than 160 degrees, more preferably less than 150 degrees.

Preferably in general use this means that the outlet section ending in second opening 5 is angled less than 70 degrees and more preferably less than 60 degrees above the horizontal plane.

The spray heads of the present invention preferably have an outlet section 4 that further comprises a front face 7 that may be planar and may be substantially vertical in normal use.

The front face 7 may provide a surface for the dispersion and evaporation of small droplets that may form at the second opening 5 of the fluid channel 6.

Preferably the front face 7 may be oval or essentially circular in shape and wherein the second end 5 of the fluid channel 6 is located at the centre of the circle or oval.

It is also preferable that the front face 7 has sufficient diameter to prevent the spray head from being inserted back-to-front within the automatic spraying device. To achieve this, preferably the diameter of the front face 7 may be between 4 and 16 mm, more preferably between 5 and 14 mm and most preferably between 6 and 12 mm. Preferably the diameter of the front face 7 will be greater than the horizontal width of the back portion of the of the spay head 1 (including both inlet and outlet sections and wings if included).

The diameter measurements of the front face 7 may be measured across the narrowest diameter in oval or other non-circular embodiments.

The spray heads of the present invention may further comprise either a flat external portion 8 at the end of the inlet section, or a hollowed portion 11 at the end of the inlet section. These modifications are particularly beneficial when the spray heads are used on aerosol cans in automatic aerosol dispensing devices.

The spray heads of the present invention may also comprise wings 10 on either side of the outlet section 4. There may be a single wing on either side of the output section 4 but preferably there will be at least two wings wherein each of the two wings is on its own side of the spray head.

The wings may be different sizes. Preferably the two wings are identical and the spray head is vertically symmetric through its central plane.

Preferably the wings are substantially planar and substantially horizontal in normal use.

The wings may be between 0.2 and 8 mm deep (as measured in the vertical direction in normal use), preferably between 0.5 and 5 mm deep and most preferably between 0.75 and 2 mm deep.

The wings 10 may be between 1 and 10 mm wide (as measured in the horizontal plane in normal use, preferably between 2 and 9 mm and most preferably between 3 and 8 mm wide. By width it is meant that the measurement is taken from the outlet section to the edge of the wing.

The wings 10 may run the entire length of the outlet section 4 from the front face 7 through to the inlet section 3. Alternatively the wings 10 may stretch only part of the way along the outlet section 4 from the inlet section 3. Preferably the wings run at least 30% of the length of outlet section 4, more preferably at least 40% of the length of the outlet section 4 and most preferably at least 50% of the length of the outlet section 4.

The wings 10 may provide additional stability to an automatic spraying system in use. The wings 10 may also provide additional strength to the spray heads and provide a mechanism to correctly orientate the aerosol can in an automatic spraying device. This orientation effect may be in used instead of the enlarged front face 7 effect or be combined with and work in conjunction with the enlarge front face 7.

The wings may be horizontal in use and may act as a guide (with equivalent matching slots on the device) for correct insertion into the device. This may have a significant impact on ease of insertion and breakage caused by incorrect insertion of the can and actuator into the spraying device.

Preferably the spray heads of the present invention are moulded from a single type of plastic. Preferably the spray heads are formed from the group comprising POM, nylon, PET, polyethylene or polypropylene. The spray heads may also be formed from mixtures of two or more of those plastics. The spray heads may be formed from mixtures of these and other polymers if required.

Preferably the spray heads of the present invention are formed using an injection moulding process.

Preferably the density of the plastic is between 1.8 grams per $cm^3$ and 0.7 grams per $cm^3$, more preferably 1.5 grams per $cm^3$ and 0.8 grams per $cm^3$ and most preferably between 1.4 grams per $cm^3$ and 0.9 grams per $cm^3$.

The lack of an insert allows for the preparation of much more compact spray heads that those of the prior art. The spray head embodiment of the present invention as shown in FIGS. 2-5 is at least 15% lighter than the spray head of the prior art shown in FIG. 1.

Preferably the spray heads of the present invention are at least 20%, more preferably at least 25% and most preferably at least 30% lighter than the prior art examples.

Preferably the total weight of the spray heads of the present invention is less than 0.7 gram, preferably less than 0.6 grams, and most preferably less than 0.55 grams.

The outlet heads or spray heads of the present invention may be used with any aerosol formulations. Preferably the spray heads of the present invention are used with aerosol formulations with hydrocarbons propellants.

The outlet heads are particularly useful with an automatic aerosol spray device.

The invention claimed is:

1. A spray head formed from a single piece of moulded plastic, the spray head comprising:

an inlet section having an opening adapted to receive a valve stem of a spray material container, said opening forming a first end of a fluid channel for receiving spray material from the spray material container; and an outlet section adapted to eject spray material comprising a second opening forming a second end of the fluid channel for ejecting spray material from the device and wherein the second opening terminates at a front face of the outlet section, the front face has a diameter which is greater than the horizontal width of the width of the inlet outlet section and of horizontal wings which depend outwardly from either side of the outlet section and which are substantially horizontal when the inlet section is vertical; and, wherein the outlet section is angled at least 5 degrees above the horizontal plane when the inlet section is vertical.

2. The spray head of claim 1, wherein:

the outlet section of a spray material container comprises the valve stem of an aerosol canister.

3. The spray head of claim 1, wherein:

the angle between the opening of the inlet section and the opening of the outlet section is at least 105 degrees.

4. The spray head of claim 3, wherein:

the angle between the opening of the inlet section and the opening of the outlet section is at least 110 degrees.

5. The spray head of claim 3, wherein:

the angle between the opening of the inlet section and the opening of the outlet section is at least 115 degrees.

6. The spray head of claim 1, wherein:

the outlet section has a front face which is essentially planar and is substantially vertical in normal use.

7. The spray head of claim 6, wherein:

the front face is essentially circular in shape and wherein the second end of the fluid channel is located at the centre of the front face.

8. The spray head of claim 1, wherein:

the single piece of moulded plastic is selected formed from a plastic of the group consisting of: POM, nylon, PET, polyethylene, polypropylene and/or mixtures of two or more thereof.

9. The spray head of claim 1, wherein:

the moulded plastic has a density of between 1.8 grams per $cm^3$ and 0.7 grams per $cm^3$.

10. The spray head of claim 1, wherein:

the spray head is adapted for use with an automatic aerosol spray device.

11. The spray head of claim 1 wherein the horizontal wings extend substantially outwardly to the same width as the front face when the spray head is viewed face on.

12. The spray head of claim 1, wherein:

the horizontal wings extend the complete length of the output section, from inlet section to the front face.

13. The spray head of claim 1, wherein:

the front face has a width greater than the width of the rest of the spray head.

14. The spray head of claim 1, wherein:

the angle between the opening of the inlet section and the second opening of the outlet section is at least 100 degrees.

15. The spray head of claim 1, wherein the spray head excludes an insert at the second opening.

* * * * *